US007181936B2

(12) United States Patent
Christensen et al.

(10) Patent No.: US 7,181,936 B2
(45) Date of Patent: Feb. 27, 2007

(54) LOCKABLE BUCKLE

(75) Inventors: Myles Christensen, Pueblo West, CO (US); Jeffrey D. Swan, West Chester, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 11/115,397

(22) Filed: Apr. 27, 2005

(65) Prior Publication Data

US 2006/0243006 A1 Nov. 2, 2006

(51) Int. Cl.
*E05B 73/00* (2006.01)
*E05B 11/00* (2006.01)

(52) U.S. Cl. ..... 70/58; 70/389

(58) Field of Classification Search ..... 70/14, 70/18, 57, 58, 389, 390, 491; 24/614, 615, 24/167, 625

See application file for complete search history.

(56) References Cited

U.S. PATENT DOCUMENTS 41,177 A * 1/1864 Harold ..... 70/491
533,442 A * 2/1895 Deibert ..... 70/13
2,386,766 A * 11/1945 Ruttiman ..... 70/16
2,894,082 A * 7/1959 Collotta ..... 200/43.08
3,702,550 A * 11/1972 Shimizu ..... 70/252
4,912,950 A 4/1990 Crowle
4,930,324 A 6/1990 Meier
5,117,663 A * 6/1992 Ida ..... 70/64
6,871,517 B2 * 3/2005 Bonelli et al. ..... 70/58
2005/0055810 A1 * 3/2005 Loughlin et al. ..... 24/615

* cited by examiner

*Primary Examiner*—Lloyd A. Gall
(74) *Attorney, Agent, or Firm*—Lempia Forman LLC

(57) ABSTRACT

A buckle assembly is described. The buckle assembly includes a buckle body, a fastener and a key. The buckle body includes a recess and a lock tumbler. The fastener is configured to slide within the recess. The key is configured to fit within a key hole of the lock tumbler. When the key is in a locked rotational orientation within the key hole and the fastener is engaged in the recess, the tumbler is in a locked orientation and the fastener may not be slid from the recess. When the key is in an unlocked rotational orientation within the key hole and the fastener is engaged in the recess, the tumbler is in an unlocked orientation and the fastener may be slid from the recess. A key removal prevention mechanism prevents the key from being removed from the key hole when the key is in the unlocked rotational orientation whether or not the fastener is engaged in the recess.

19 Claims, 9 Drawing Sheets

LOCKABLE BUCKLE

FIELD OF THE INVENTION

This invention relates to a lockable buckle. More specifically, this invention relates to a buckle assembly and buckle subassembly.

BACKGROUND OF THE INVENTION

Lockable buckles can include a buckle body and strap fastener that may be locked to the buckle body. Such lockable buckles also can include a locking mechanism, such as a key, where the key is rotated within a key hole of the buckle body to lock or unlock the strap fastener with respect to the buckle body. When unlocked, the strap fastener may be separated from the buckle body, and, when locked, the strap fastener may not be separated from the buckle body.

SUMMARY OF THE INVENTION

One aspect of the invention relates to a lockable buckle assembly. The lockable buckle assembly comprises: a buckle body including a recess and a lock tumbler; a fastener configured to slide within the recess; a key configured to fit within a key hole of the lock tumbler, wherein when the key is in a locked rotational orientation within the key hole and the fastener is engaged in the recess, the tumbler is in a locked orientation and the fastener may not be slid from the recess, and when the key is in an unlocked rotational orientation within the key hole and the fastener is engaged in the recess, the tumbler is in an unlocked orientation and the fastener may be slid from the recess; and a key removal prevention mechanism that prevents the key from being removed from the key hole when the key is in the unlocked rotational orientation whether or not the fastener is engaged in the recess.

Another aspect of the invention relates to a lockable buckle assembly. The lockable buckle assembly comprises: a buckle body including a recess and a lock tumbler; a fastener configured to slide within the recess; a key configured to fit within a key hole of the lock tumbler, wherein when the key is in a locked rotational orientation within the key hole and the fastener is engaged in the recess, the tumbler is in a locked orientation and the fastener may not be slid from the recess, and when the key is in an unlocked rotational orientation within the key hole and the fastener is engaged in the recess, the tumbler is in an unlocked orientation and the fastener may be slid from the recess; and a key rotation prevention mechanism that prevents the key from being rotated from the unlocked rotational orientation to the locked rotational orientation unless the fastener is engaged in the recess.

Yet another aspect of the invention relates to a lockable buckle subassembly for use with a key. The subassembly comprises: a buckle body including a recess and a lock tumbler; a fastener configured to slide into the recess; and a tumbler configured to have a locked orientation and an unlocked orientation, wherein when the tumbler is in the locked orientation and the fastener is engaged in the recess, the fastener may not be slid from the recess, and when the tumbler is in the unlocked orientation and the fastener is engaged in the recess, the fastener may be slid from the recess, and wherein when the key is inserted into a key hole of the tumbler, the key may be removed from the key hole only when the tumbler is in the locked orientation.

Yet another aspect of the invention relates to a lockable buckle subassembly for use with a key. The subassembly comprises: a buckle body including a recess and a lock tumbler; a fastener configured to slide into the recess; a tumbler configured to have a locked orientation and an unlocked orientation, wherein when the tumbler is in the locked orientation and fastener is engaged in the recess, the fastener may not be slid from the recess, and when the tumbler is in the unlocked orientation and the fastener is engaged in the recess, the fastener may be slid from the recess; and a tumbler unlatching mechanism that unlatches the tumbler to allow the tumbler to be rotated from the locked orientation to the unlocked orientation upon the key being inserted into a key hole of the tumbler.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

FIGS. 1–10 illustrate a lockable buckle assembly 10 of a simple and robust design according to an embodiment of the invention. The buckle assembly 10 generally includes a buckle body 12, a fastener 14 such as a strap fastener, and a key 16. The lockable buckle assembly 10 can meet the following criteria: 1) the key can only be removed from the buckle body 12 when the buckle body 12 is in a locked orientation, 2) the buckle body 12 cannot be moved to an unlocked orientation without the key, and 3) the key cannot be removed from the buckle body 12 unless the fastener 14 is engaged with the buckle body 12. The first criteria ensures that, when the key 16 is removed, the buckle body 12 and the fastener 14 are locked together. The second criteria ensures that some object other than the key 16, for example a screwdriver, cannot readily be used to open the buckle assembly 10. The third criteria makes it less likely that the key 16 will be separated from the buckle body 12 when the fastener 14 of the buckle assembly 10 is disengaged from the buckle body 12.

This buckle assembly 10 may be employed as a buckle in systems where an object having at least one strap (associated with the fastener) is to be secured to another object (on which the buckle body is mounted). In one embodiment, the buckle assembly 10 can be used in a child's playard to close a soft door of the playard. In this context, the fastener 14 may be mounted to the soft door by a first strap, and the buckle body 12 may be mounted to a sidewall of the playard by a second strap, such that, when the buckle body 12 and the fastener 14 are secured together, the soft door of the playard is closed.

Figure 1:
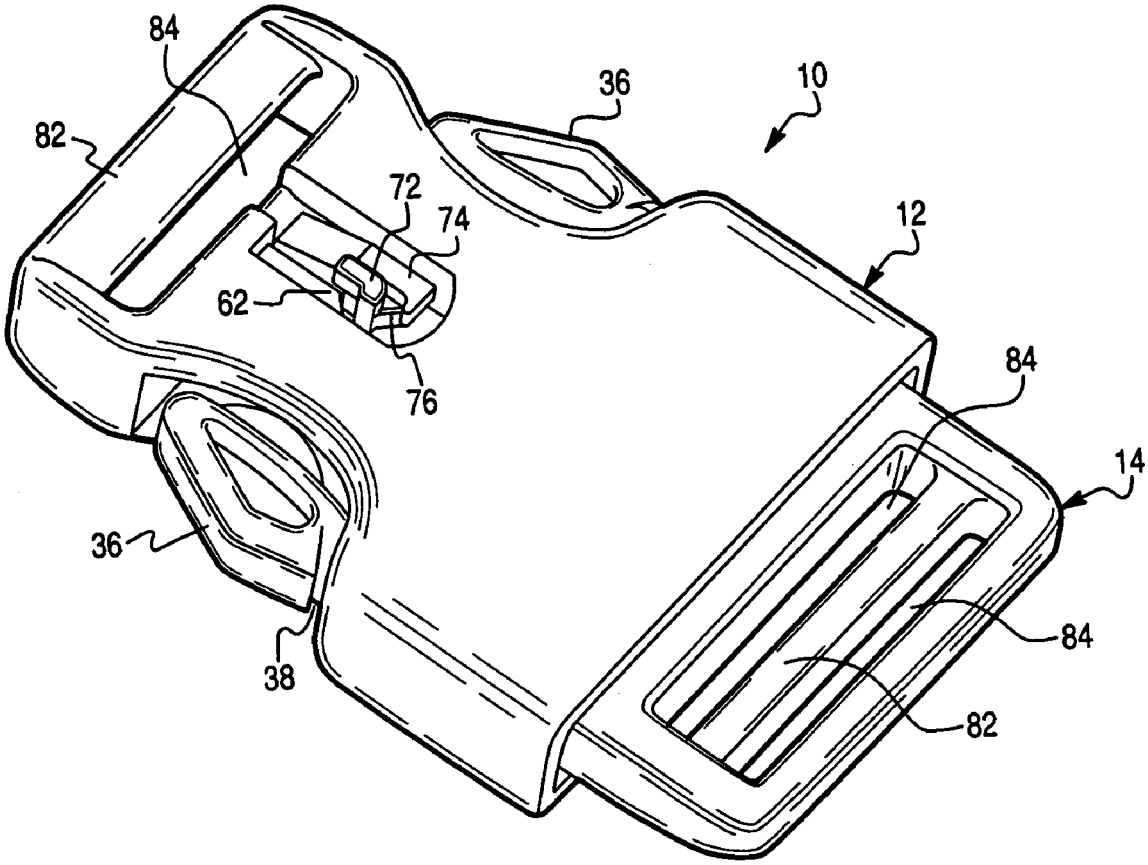
FIG. 1 is a bottom perspective view that illustrates a buckle assembly in assembled form according to an embodiment of the invention.
Figure 2:
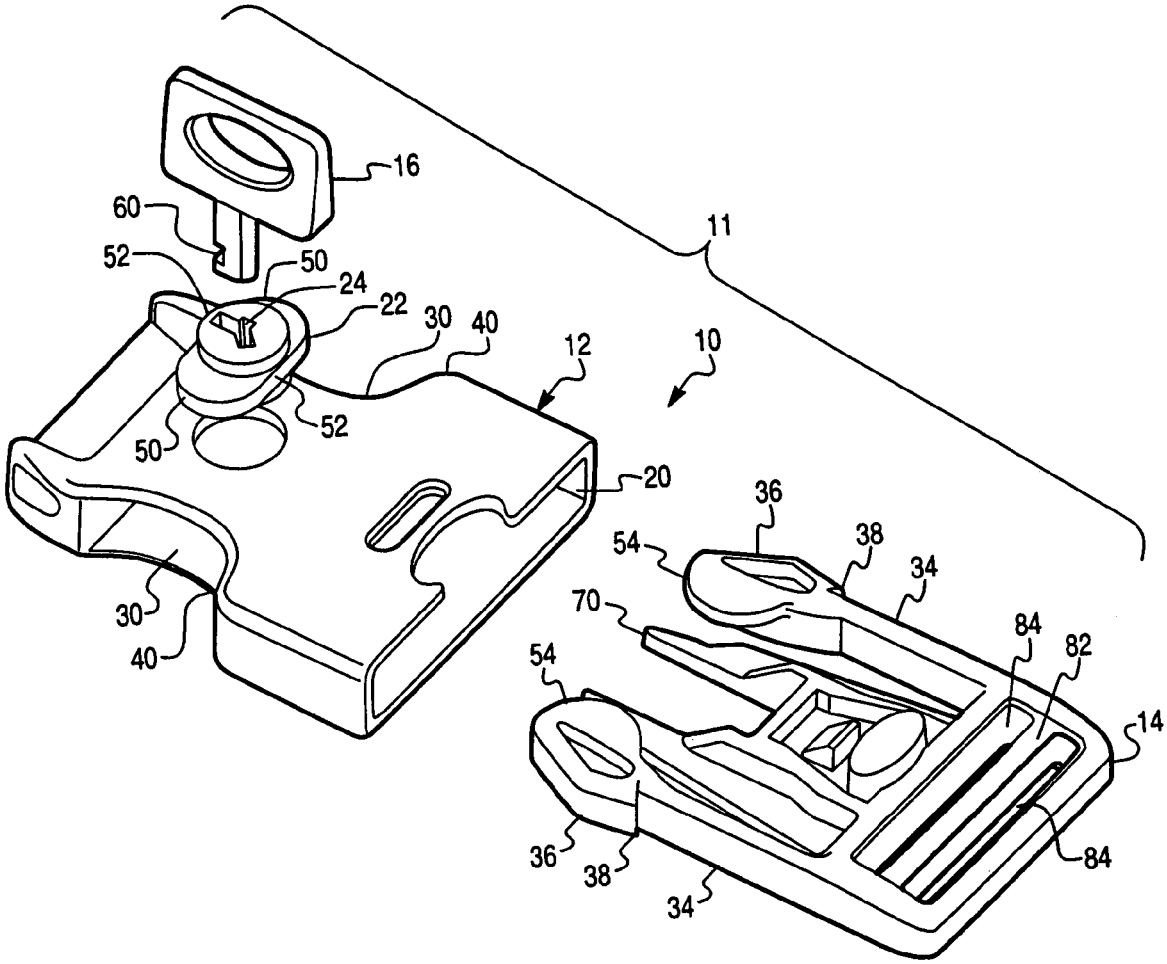
FIG. 2 is a top exploded perspective view of the buckle assembly of FIG. 1.
Figure 3:
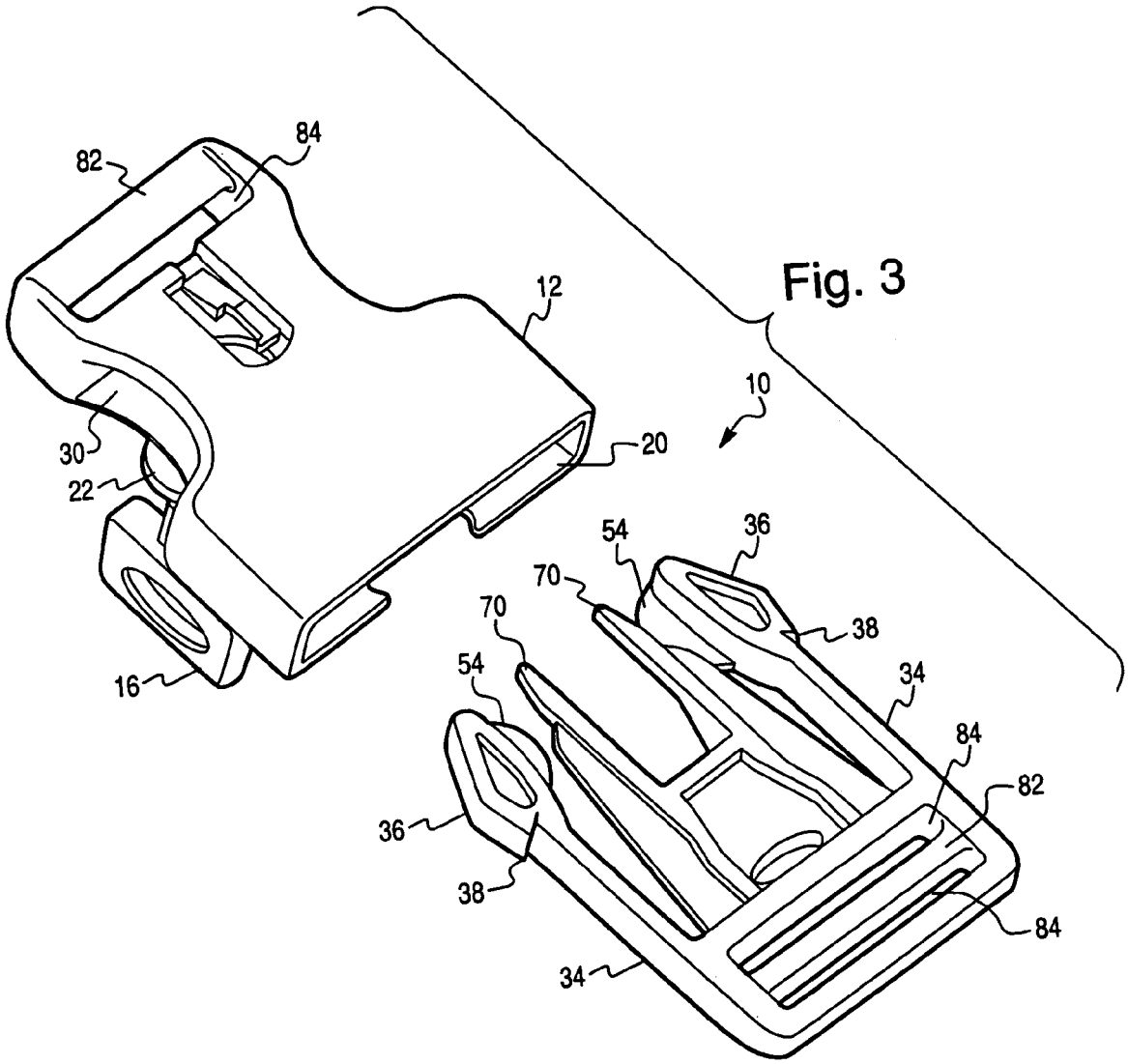
FIG. 3 is bottom exploded perspective view of the buckle assembly of FIG. 1.

FIG. 1 illustrates the buckle assembly 10 in an assembled configuration. The buckle assembly 10 may be made from acetyl material, or materials such as nylon or polycarbonate, for example.

Together the buckle body 12 and the fastener 14 comprise a buckle subassembly of the buckle assembly 10. The buckle body 12 has a recess 20 into which the fastener 14 may be slid to engage the buckle body 12. The buckle body 12 also has a lock tumbler 22 that may be rotated by means of the key 16 when the key 16 is fitted within a key hole 24 of the lock tumbler 22. The tumbler 22 has a locked orientation (see FIG. 4) and an unlocked orientation (see FIG. 5). When the fastener 14 is engaged in the recess 20 and the tumbler 22 is in the locked orientation, the fastener 14 may not be slid from the recess 20. Conversely, when the fastener 14 is engaged in the recess and the tumbler 22 is in the unlocked orientation, the fastener 14 may be slid from the recess 20 as discussed further below, and the fastener 14 thus may be separated from the buckle body 12.

Figure 4:
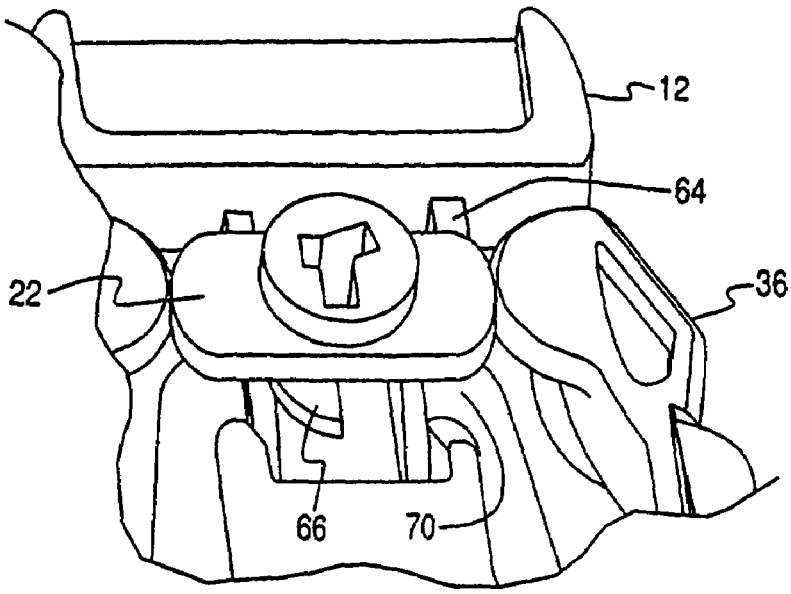
FIG. 4 is a cutaway view of the buckle assembly of FIG. 1 with a tumbler in a locked orientation.
Figure 5:
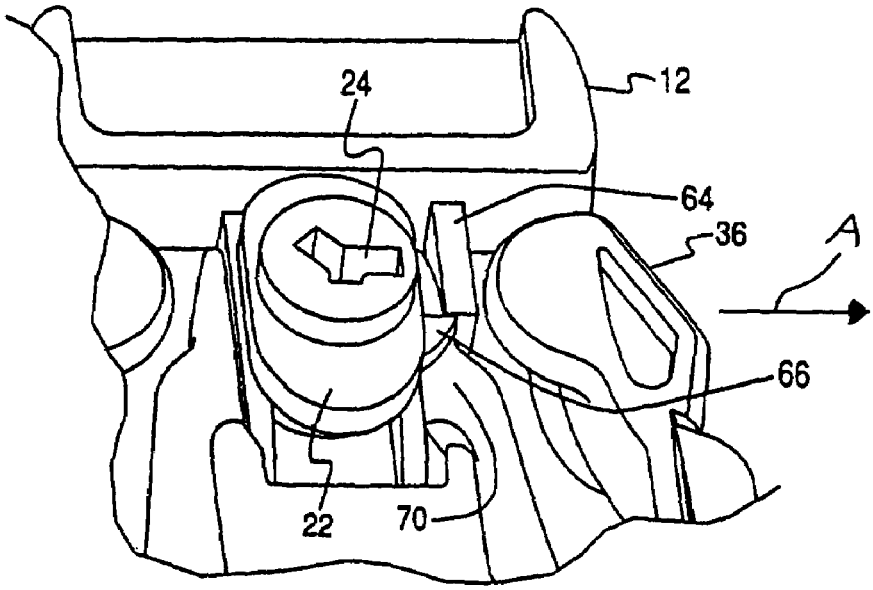
FIG. 5 is a cutaway view of the buckle assembly of FIG. 1 with the tumbler in an unlocked orientation.
Figure 6:
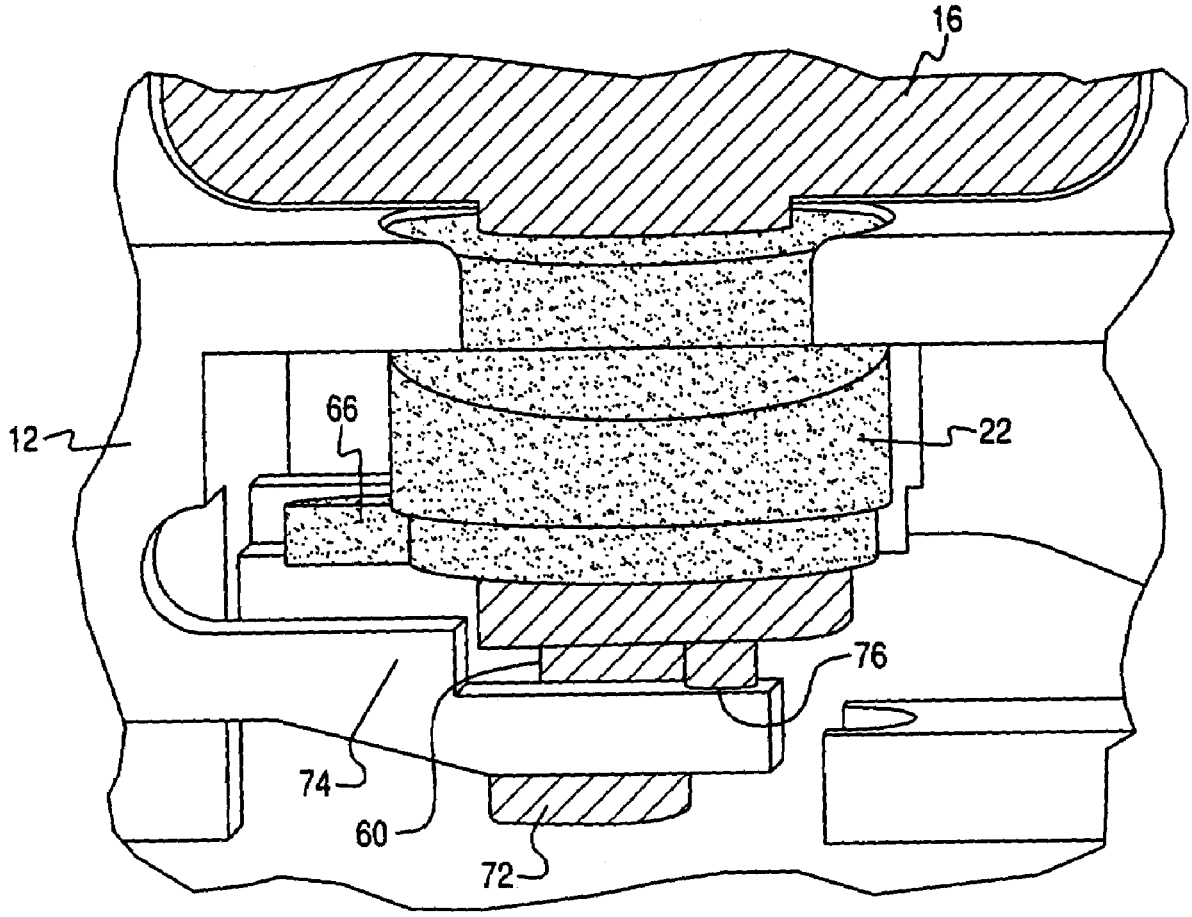
FIG. 6 is a cutaway side view of the buckle assembly of FIG. 1 with the tumbler in a locked orientation.

The key 16 is configured to be engaged within the key hole 24 of the tumbler 22. When the fastener 14 is engaged in the recess 20 and the key 16 is rotated to a first rotational orientation within the key hole 24, the tumbler 22 is rotated to the locked orientation, as shown in FIG. 4. Conversely, when the fastener 14 is engaged in the recess 20 and the key 16 is rotated to a second rotational orientation within the key hole 24, the tumbler 22 is rotated to the unlocked orientation, as shown in FIG. 5.

When the tumbler 22 is in the unlocked orientation, the fastener 14 may be slid from the recess 20 as follows. The buckle body 12 comprises at least one side hole, such as the two opposing side holes 30 shown in the drawings. The fastener 14 correspondingly includes at least one flexible elongated side member, such as the two opposing flexible elongated side members 34 shown in the drawings. Each of the elongated side members 34 corresponds to one of the side holes 30. Each of the side members 34 has an end member 36 with a ridge 38. Each ridge 38 may engage a side 40 of its respective side hole 30 to prevent the fastener 14 from being slid from the recess 20 when the ridge 38 is so engaged. In order to slide the fastener 14 from the recess 20, the end members 36 may be deflected within their respective side holes 30 to disengage the ridges 38 from corresponding sides 40. For example, for the two opposing side holes 30 and two opposing flexible elongated side members 34 as shown, a user may deflect the end members 36 within their respective side holes 30 by grasping the end members 36 with a thumb and one or more fingers and pressing the end members 36 toward each other.

When the tumbler 22 is in a locked orientation, the tumbler 22 prevents the end members 36 from being deflected within their corresponding side holes 30. Conversely, when the tumbler 22 is in an unlocked orientation, the tumbler 22 allows the end members 36 to be deflected within its their corresponding side holes 30. In this regard, the tumbler 22 has a widened periphery portion 50 and a narrowed periphery portion 52, and the end members 36 each have a widened portion 54. The widened portions 54 prevent the end members 36 from being deflected within the recess 20 by contacting the widened periphery portion 50 of the tumbler 22 when the tumbler 22 is in the locked orientation. Conversely, when the fastener 14 is engaged in the recess 20 and the tumbler 22 is in the unlocked orientation, the tumbler 22 allows the end members 36 to be deflected within their respective side holes 30, because the end members 36 now face the narrowed periphery portion 52 of the tumbler 22. Thus, the fastener 14 is allowed to be slid from the recess 20.

The buckle assembly 10 includes a key removal prevention mechanism. In one embodiment, the key removal prevention mechanism comprises a notch 60 on the key 16 (see retention rib 62 on the buckle body 12, a stop 66 on the tumbler 22, and a finger 64 on the buckle body 12). The key removal prevention mechanism acts to prevent the key 16 from being removed from the key hole 24 when the key 16 is in the second rotational orientation (corresponding to the unlocked orientation of the tumbler 22), whether or not the fastener 14 is engaged in the recess 20. The key removal prevention mechanism also prevents the key 16 from being rotated to the second rotational orientation from the first rotational orientation (corresponding to the locked orientation of the tumbler 22) unless the fastener 14 is engaged in the recess 20.

Figure 7:
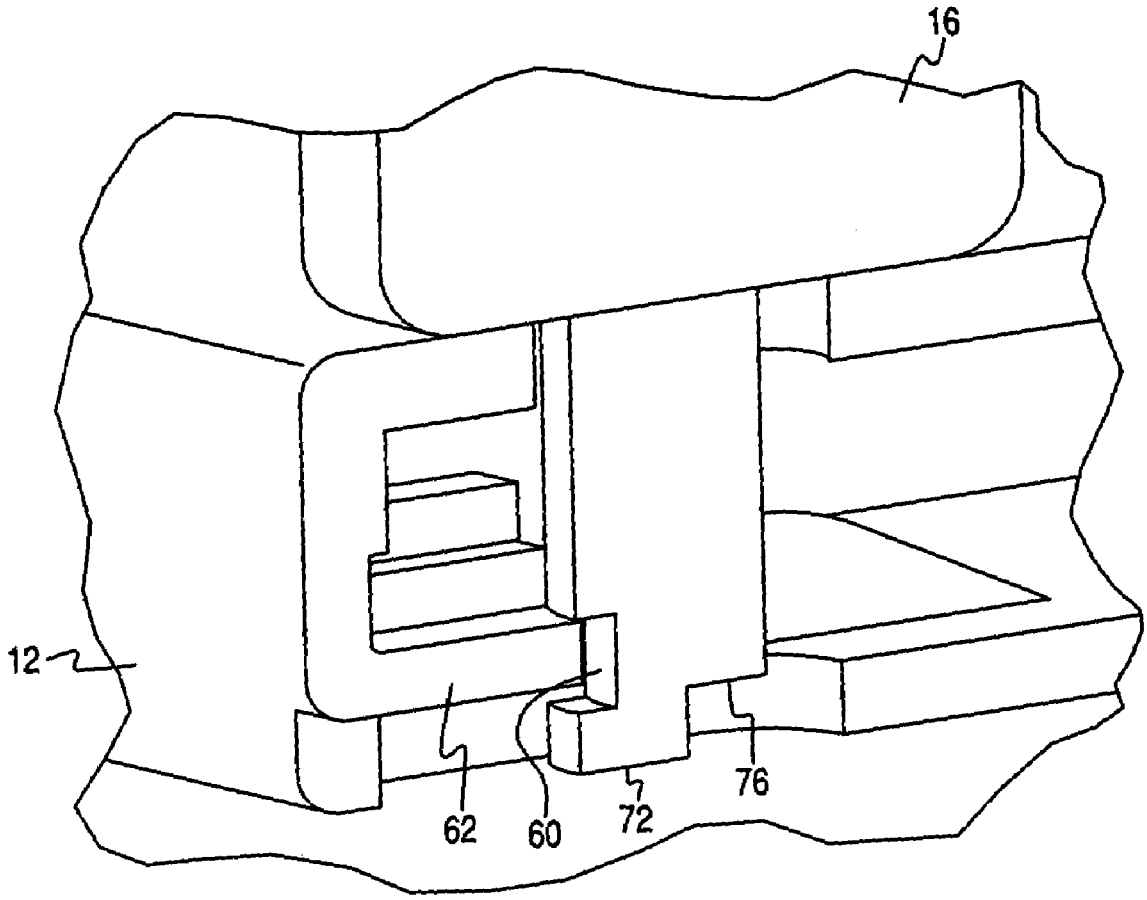
FIG. 7 is a cutaway side view of the buckle body and the key of the buckle assembly of FIG. 1 with the key in a first rotational orientation.
Figure 8:
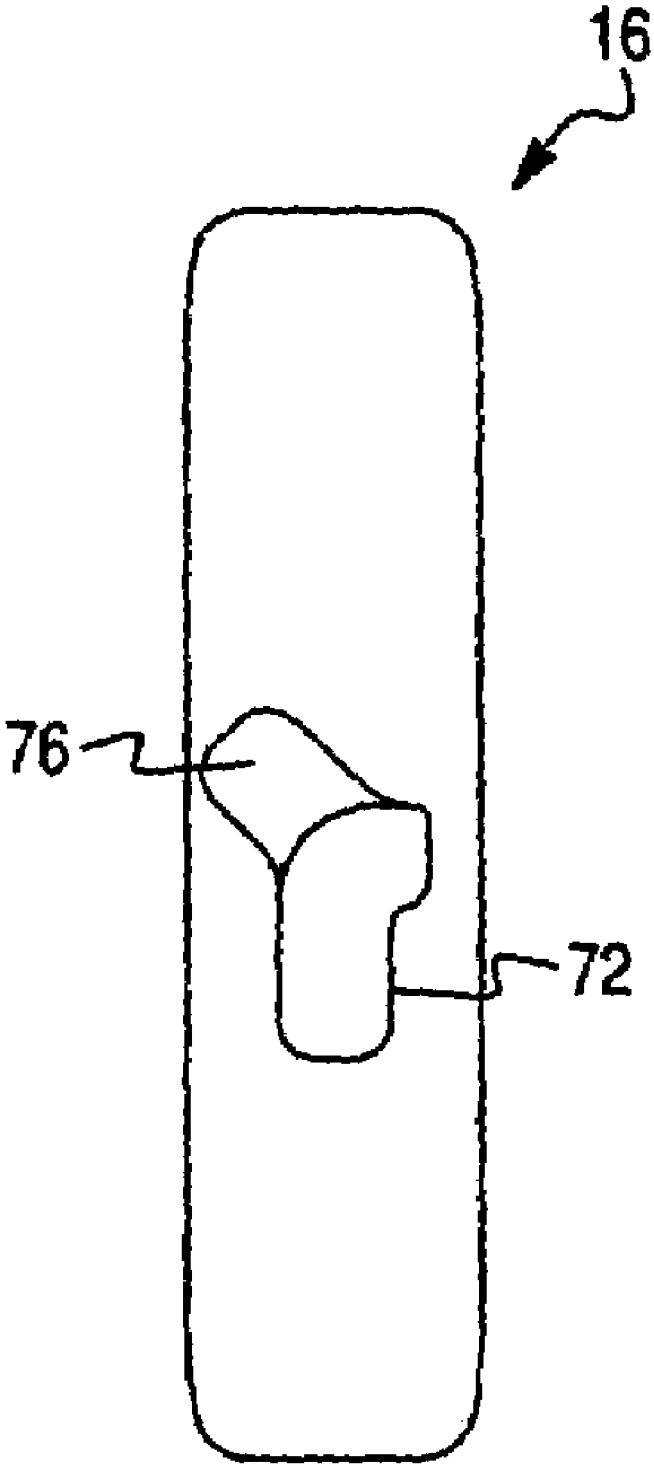
FIG. 8 is a bottom view of the key.
Figure 9:
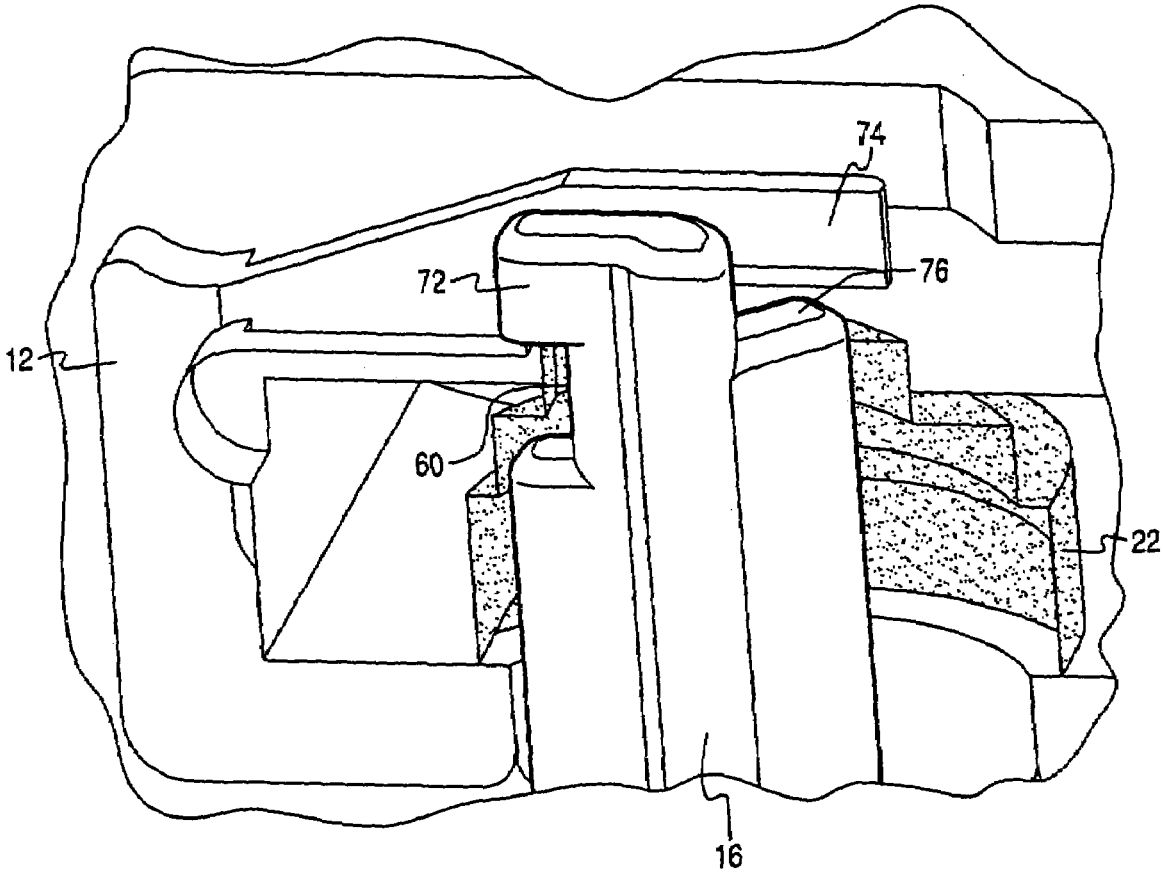
FIG. 9 is another cutaway side view of the buckle body and the key of the buckle assembly of FIG. 1.
Figure 10:
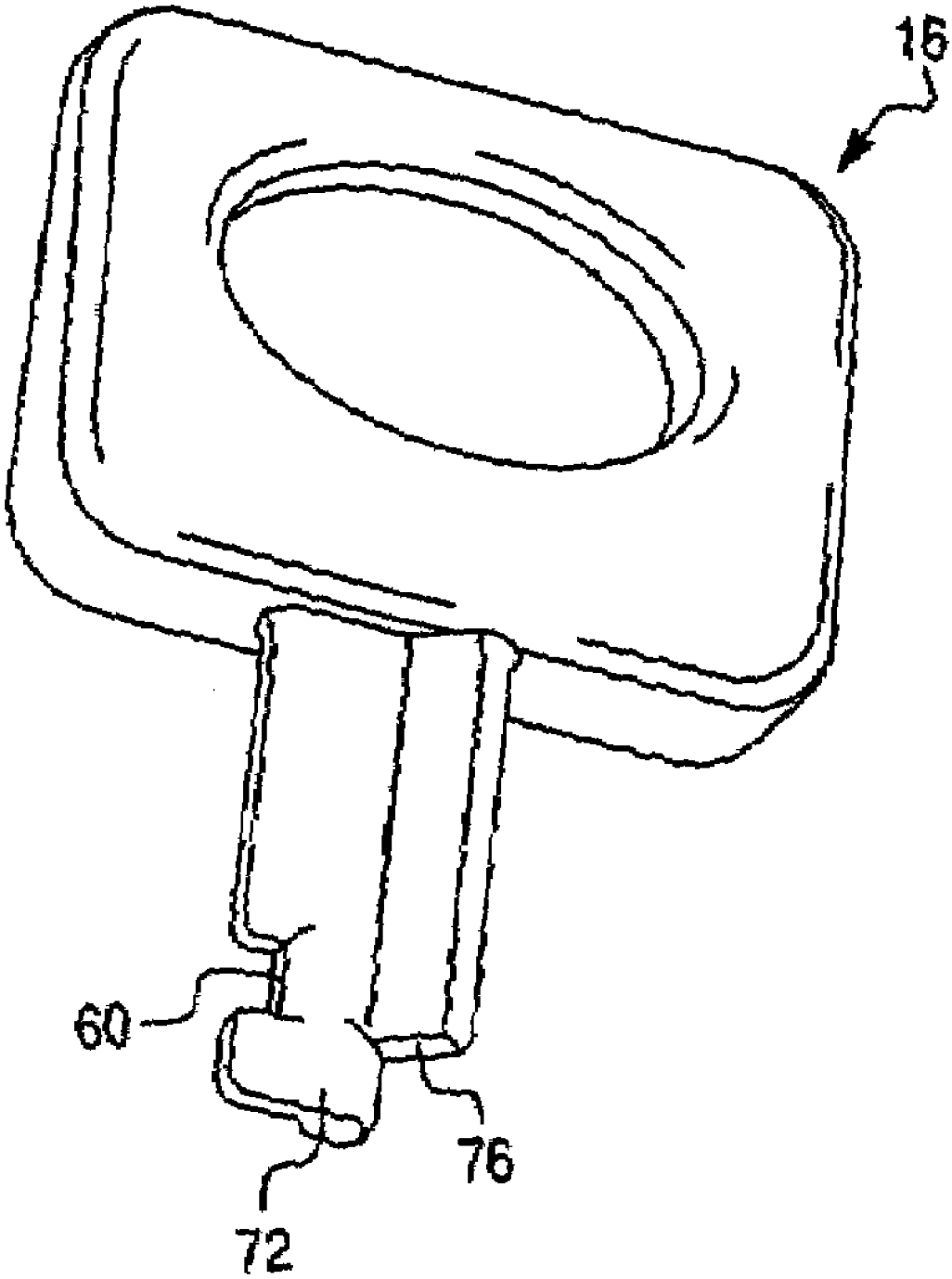
FIG. 10 is a perspective view of the key.

As shown in FIG. 7, the retention rib 62 is free from interference with the notch 60 when the key 16 is in the first rotational orientation (and thus the tumbler 22, not shown in FIG. 7, is in the locked orientation). When the retention rib 62 engages the notch 60 (i.e., when the key is in the second rotational orientation and the tumbler 22 is in the unlocked orientation), the key 16 may not be pulled from the key hole 24.

The stop 66 and finger 64 together provide a key rotation prevention mechanism of the key removal prevention mechanism, where the key rotation prevention mechanism prevents the key 16 from being rotated to the first rotational orientation (corresponding to the locked orientation of the tumbler 22), unless the strap fastener 14 is engaged in the recess 20. In this regard, when the fastener 14 is not engaged within the recess 20, the finger 64 contacts the stop 66 and thereby prevents the key 16 from being rotated to the first rotational orientation from the second rotational orientation (and thus prevents the tumbler 22 from being rotated to the locked orientation from the unlocked orientation). Conversely, as can be understood from FIG. 5, when the fastener 14 is engaged within the recess 20, a release rib 70 on the fastener deflects the finger 64 laterally in the direction of Arrow A so that the finger 64 no longer contacts the stop 66, and thus the key 16 is allowed to rotate to the first rotational orientation from the second rotational orientation (and the tumbler 22 is allowed to rotate to the locked orientation from the unlocked orientation). In FIG. 5, the fastener 14 is not fully engaged in the recess, so the stop 66 is in contact with the finger 64. If the fastener 14 were fully engaged in the recess 20, then the finger 64 would be deflected in the direction of Arrow A in FIG. 5 a sufficient distance to provide clearance between the stop 66 and the finger 64.

The buckle assembly 10 further includes a tumbler unlatching mechanism that allows the buckle assembly 10 to be readily unlocked only with the key 16 as best shown in FIGS. 1, and 6–10. The tumbler unlatching mechanism unlatches the tumbler to allow the tumbler 22 to be rotated from the locked orientation to the unlocked orientation. The tumbler unlatching mechanism may comprise, for example, a stop 72 and an engaging portion 76 on the key 16, and a flexible finger 74 on the buckle body 12. When the key 16 is fully inserted into the tumbler 22, the engaging portion 76 engages flexible finger 74 (see FIG. 6). As the key 16 is pushed into the tumbler 22, the flexible finger 74 is pushed down by the engaging portion 76 so that the retention rib 62 aligns with the notch 60 (see FIGS. 1, and 6–10, where hatching in FIG. 6 denotes the key 16, and the stipling in FIGS. 6 and 9 denotes the tumbler 22). When the retention rib 62 is aligned with the notch 60, the key 16 may be rotated to rotate the tumbler 22 from the locked orientation to the unlocked orientation. If the key 16 is not inserted properly so that the engaging portion 76 does not push the flexible finger 74 down and out of the way, the stop 72 will contact the retention rib 62 when a user attempts to rotate the key 16 from the locked position to the unlocked position, preventing rotation. Thus, unless the key 16 is inserted into the tumbler 22 to bias the finger 74, the key 16 is prevented from being rotated to the second rotational orientation from the first rotational orientation (and thus the tumbler 22 is prevented from being rotated to the unlocked orientation from the locked orientation).

The buckle body 12 and fastener 14 may each have structure to retain a strap (not shown). For example, the buckle body 12 and fastener 14 may each have a bar 82 and one or more recesses 84 to allow respective straps to be retained.

In the buckle assembly 10 of this embodiment, when the key 16 is inserted into and is engaged with the key hole 24, the key 16 may be removed from the key hole 24 only when the tumbler 22 is in the locked orientation. In this fashion, it is ensured that when the key 16 is removed, the buckle body 12 is locked to the fastener 14.

Further, in the buckle assembly 10 of this embodiment, the key 16 cannot be removed from the tumbler 22 unless the fastener 14 is engaged with the buckle body 12. Thus, the key 16 will be less likely to be separated from the buckle body 12 when the fastener 14 is disengaged from the buckle body 12.

The applications for the buckle assembly 10 are not limited to use with a child's playard. The buckle assembly 10 may be used in other applications, such as with luggage and diaper bags, for example. The buckle assembly 10 is especially useful in security and safety applications, and prevents theft of the key when the fastener 14 is disengaged from the buckle body 12. Further, the buckle assembly 10 ensures that when the key 16 is not in the tumbler 22, the buckle assembly 10 will be locked.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A lockable buckle assembly comprising:

a buckle body including a recess and a lock tumbler;

a fastener configured to slide within the recess;

a key configured to fit within a key hole of the lock tumbler, wherein when the key is in a locked rotational orientation within the key hole and the fastener is engaged in the recess, the tumbler is in a locked orientation and the fastener may not be slid from the recess, and when the key is in an unlocked rotational orientation within the key hole and the fastener is engaged in the recess, the tumbler is in an unlocked orientation and the fastener may be slid from the recess; and a key removal prevention mechanism that prevents the key from being removed from the key hole when the key is in the unlocked rotational orientation whether or not the fastener is engaged in the recess.

2. The lockable buckle assembly according to claim 1, wherein the key removal prevention mechanism prevents the key from being rotated from the unlocked rotational orientation to the locked rotational orientation unless the fastener is engaged in the recess.

3. The lockable buckle assembly according to claim 1, wherein the key removal prevention mechanism comprise:

a notch on the key; and a retention rib on the buckle body configured to engage the notch when the key is in the unlocked rotational orientation.

4. The lockable buckle assembly according to claim 2, wherein the key removal prevention mechanism comprises:

a stop on the tumbler; and a finger on the buckle body configured to contact the stop in response to insertion of the fastener in the recess and thereby prevent the key from being rotated from the unlocked rotational orientation to the locked rotational orientation unless the fastener is engaged in the recess.

5. The lockable buckle assembly according to claim 4, wherein the fastener comprises a release rib configured to deflect the finger when the fastener is engaged within the recess and thereby allow the key to be rotatable from the unlocked rotational orientation to the locked rotational orientation.

6. The lockable buckle assembly according to claim 1, wherein the buckle body comprises at least one side hole, and the fastener comprises at least one flexible elongated side member having an end member, wherein when the fastener is engaged in the recess and the tumbler is in a locked orientation, the end member protrudes from the side hole to prevent the fastener from being slid from the recess.

7. The lockable buckle assembly according to claim 6, wherein when the fastener is engaged in the recess and the tumbler is in a locked orientation, the tumbler prevents the end member from being deflected within the recess.

8. The lockable buckle assembly according to claim 6, wherein the at least one side hole comprises two opposing side holes, and the at least one flexible elongated side member comprises two opposing side members.

9. The lockable buckle assembly according to claim 6, wherein when the fastener is engaged in the recess and the tumbler is in the unlocked orientation, the tumbler allows the end member to be deflected within the recess to allow the fastener to be slid from the recess.

10. The lockable buckle assembly according to claim 6, wherein the end member comprises a ridge adapted to engage a side of the side hole to prevent the fastener from being slid from the recess when the ridge is engaged.

11. The lockable buckle assembly according to claim 10, wherein the tumbler has a widened periphery portion, and the end member comprises a widened portion configured to prevent the end member from being deflected within the recess by contacting the widened periphery portion when the key is in the locked rotational orientation.

12. The lockable buckle assembly according to claim 11, wherein the tumbler comprises a narrowed periphery portion such that, when the fastener is engaged in the recess and the tumbler is in the unlocked orientation, the tumbler allows the end member to be deflected within the recess to allow the fastener to be slid from the recess.

13. The lockable buckle assembly according to claim 1, wherein each of the buckle body and the fastener comprise a bar and at least one strap recess configured to retain a strap.

14. The lockable buckle assembly according to claim 1, wherein the fastener comprises a bar and at least one strap recess configured to retain a strap.

15. A lockable buckle assembly comprising:

a buckle body including a recess and a lock tumbler;

a fastener configured to slide within the recess;

a key configured to fit within a key hole of the lock tumbler, wherein when the key is in a locked rotational orientation within the key hole and the fastener is engaged in the recess, the tumbler is in a locked orientation and the fastener may not be slid from the recess, and when the key is in an unlocked rotational orientation within the key hole and the fastener is engaged in the recess, the tumbler is in an unlocked orientation and the fastener may be slide from the recess; and a key rotation prevention mechanism that prevents the key from being rotated from the unlocked rotational orientation to the locked rotational orientation unless the fastener is engaged in the recess.

16. The lockable buckle assembly according to claim 15, wherein the key rotation prevention mechanism comprises:

a stop on the tumbler; and a finger on the buckle body configured to contact the stop and thereby prevent the key from being rotated from the unlocked rotational orientation to the locked rotational orientation unless the fastener is engaged in the recess.

17. A lockable buckle subassembly for use with a key, the subassembly comprising:

a buckle body including a recess and a lock tumbler;

a fastener configured to slide into the recess; and wherein the tumbler is configured to have a locked orientation and an unlocked orientation, wherein when the tumbler is in the locked orientation and the fastener is engaged in the recess, the fastener may not be slid from the recess, and when the tumbler is in the unlocked orientation and the fastener is engaged in the recess, the fastener may be slid from the recess, and wherein when the key is inserted into a key hole of the tumbler, the key may be removed from the key hole only when the tumbler is in the locked orientation.

18. A lockable buckle subassembly for use with a key, the subassembly comprising:

a buckle body including a recess, a retention rib, and a lock tumbler;

a fastener configured to slide into the recess;

a tumbler configured to have a locked orientation and an unlocked orientation, wherein when the tumbler is in the locked orientation and the fastener is engaged in the recess, the fastener may not be slid from the recess, and when the tumbler is in the unlocked orientation and the fastener is engaged in the recess, the fastener may be slide from the recess; and a tumbler unlatching mechanism that unlatches the tumbler to allow the tumbler to be rotated from the locked orientation to the unlocked orientation only upon the key being inserted into a key hole of the tumbler, wherein insertion of the key biases a finger on the buckle body to a position whereby a notch formed in the key becomes aligned with the retention rib such that the tumbler can be rotated from the locked rotational orientation to the unlocked rotational orientation.

19. The lockable buckle subassembly according to claim 18, wherein the tumbler unlatching mechanism comprises:

a stop on the key;

an engaging portion on the key; and wherein the engaging portion is configured to contact and bias the finger when the key is pushed into the key hole to allow the tumbler to be rotated from the locked rotational orientation to the unlocked rotational orientation, and the stop is configured to prevent the tumbler from being rotated from the locked rotational orientation to the unlocked rotational orientation when the key is inserted into the keyhole but the finger is not biased.

* * * * *